US009829184B2

(12) United States Patent
Ladstaetter

(10) Patent No.: US 9,829,184 B2
(45) Date of Patent: Nov. 28, 2017

(54) SUPPORT RAIL FOR HOLDING AND SUPPLYING POWER TO A PLURALITY OF LIGHTING MODULES, AND LIGHT STRIP SYSTEM WITH SUCH A SUPPORT RAIL

(71) Applicant: ZUMTOBEL LIGHTING GMBH, Dornbirn (AT)

(72) Inventor: Gerald Ladstaetter, Klaus (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 364 days.

(21) Appl. No.: 14/396,792

(22) PCT Filed: May 13, 2013

(86) PCT No.: PCT/EP2013/059791

§ 371 (c)(1),
(2) Date: Oct. 24, 2014

(87) PCT Pub. No.: WO2013/171148

PCT Pub. Date: Nov. 21, 2013

(65) Prior Publication Data

US 2015/0109772 A1 Apr. 23, 2015

(30) Foreign Application Priority Data

May 14, 2012 (DE) ..... 20 2012 101 765 U

(51) Int. Cl.
*F21V 21/35* (2006.01)
*F21S 4/00* (2016.01)
(Continued)

(52) U.S. Cl.
CPC ..... *F21V 21/35* (2013.01); *F21S 4/20* (2016.01); *F21S 4/28* (2016.01); *F21V 21/34* (2013.01);
(Continued)

(58) Field of Classification Search
CPC ..... F21V 21/34; F21V 21/35; F21V 23/06; F21V 23/023; F21V 21/025; F21S 4/20;
(Continued)

(56) References Cited

U.S. PATENT DOCUMENTS 6,086,222 A * 7/2000 Juba ..... F21S 4/10 362/123
7,063,442 B2 * 6/2006 Sugar ..... F21S 4/10 362/219
(Continued)

FOREIGN PATENT DOCUMENTS

CN 201198968 2/2009
CN 201351861 11/2009
(Continued)

OTHER PUBLICATIONS

International Search Report for PCT/EP2013/059791, English translation attached to original, Both completed by the European Patent Office on Aug. 13, 2013, All together 7 Pages.
(Continued)

*Primary Examiner* — Thai Pham
(74) *Attorney, Agent, or Firm* — Brooks Kushman P.C.

(57) ABSTRACT

A support rail for holding and supplying power to a plurality of lighting modules. The support rail has first conductors for forming a first power supply circuit and second conductors for forming a second power supply circuit. The support rail additionally has a converter unit for electrically coupling the second power supply circuit to the first power supply circuit. The second power supply circuit also has a first coupling element for electrically connecting a first lighting module and a second coupling element for electrically connecting a second lighting module. The result of this design of the second power supply circuit is that a single converter unit is sufficient for converting a voltage for supplying power to the two lighting modules. In this way a particularly cost-effec-
(Continued)

Figure 1:
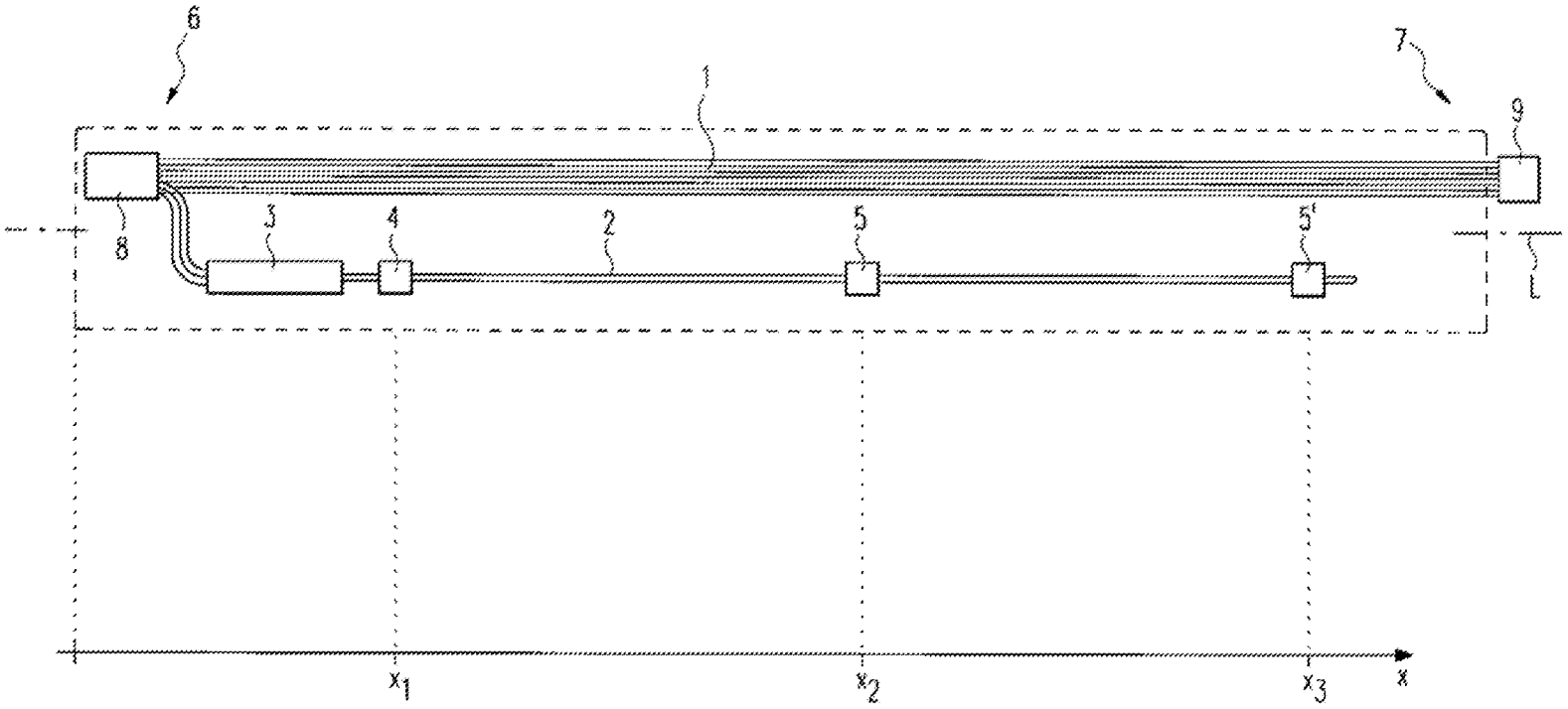

tive and compact construction of the support rail becomes possible.

13 Claims, 5 Drawing Sheets

(51) Int. Cl.

| | |
|---|---|
| ***F21V 23/06*** | (2006.01) |
| ***H01R 25/14*** | (2006.01) |
| ***H01R 25/16*** | (2006.01) |
| ***F21V 21/34*** | (2006.01) |
| ***F21S 4/20*** | (2016.01) |
| ***F21S 4/28*** | (2016.01) |
| *F21V 21/02* | (2006.01) |
| *F21V 23/02* | (2006.01) |
| *F21Y 103/10* | (2016.01) |
| *F21Y 115/10* | (2016.01) |

(52) U.S. Cl.
CPC ..... *F21V 23/06* (2013.01); *H01R 25/145* (2013.01); *H01R 25/162* (2013.01); *F21V 21/025* (2013.01); *F21V 23/023* (2013.01); *F21Y 2103/10* (2016.08); *F21Y 2115/10* (2016.08)

(58) Field of Classification Search
CPC .. F21S 4/00; F21S 4/28; H01R 25/145; H01R 25/162
See application file for complete search history.

(56) References Cited

U.S. PATENT DOCUMENTS

| | | | | |
|---|---|---|---|---|
| 2002/0114155 | A1 | 8/2002 | Katogi et al. | |
| 2003/0015968 | A1 | 1/2003 | Allen | |
| 2005/0141219 | A1* | 6/2005 | Skegin | F21S 8/04 362/240 |
| 2007/0167043 | A1 | 7/2007 | Lehman et al. | |
| 2007/0274084 | A1* | 11/2007 | Kan | F21V 5/002 362/373 |
| 2009/0147504 | A1* | 6/2009 | Teeters | F21V 23/06 362/153 |
| 2015/0192285 | A1* | 7/2015 | Chen | F21V 23/06 315/185 R |

FOREIGN PATENT DOCUMENTS

| | | |
|---|---|---|
| CN | 201892128 | 7/2011 |
| DE | 202007002128 | 5/2007 |
| DE | 202012005588 | 8/2012 |
| WO | 0191249 | 11/2001 |
| WO | 2006026575 | 3/2006 |
| WO | 2008099305 | 8/2008 |

OTHER PUBLICATIONS

Second Chinese Office Action for Chinese Application No. CN 201380023678.5, Completed by the Chinese Patent Office, dated Dec. 5, 2016, 9 Pages.

First Chinese Office Action for Chinese Application No. CN 201380023678.5, Completed by the Chinese Patent Office, dated Apr. 25, 2016, 7 Pages.

First Chinese Search Report for Chinese Application No. CN 201380023678.5, Completed by the Chinese Patent Office, dated Apr. 15, 2016, 1 Page.

Second Chinese Search Report for Chinese Application No. CN 201380023678.5, Completed by the Chinese Patent Office, dated Nov. 25, 2016, 1 Page.

* cited by examiner

SUPPORT RAIL FOR HOLDING AND SUPPLYING POWER TO A PLURALITY OF LIGHTING MODULES, AND LIGHT STRIP SYSTEM WITH SUCH A SUPPORT RAIL

CROSS-REFERENCE TO RELATED APPLICATION

This application is the U.S. national phase of PCT Application No. PCT/EP2013/059791 filed on May 13, 2013, which claims priority to DE Patent Application No. 20 2012 101 765.2 filed on May 14, 2012, the disclosures of which are incorporated in their entirety by reference herein.

The invention relates to a support rail for holding and supplying power to a plurality of lighting modules. In addition, the invention relates to a light strip system with such a support rail.

A light strip system with a support rail is known from WO 01/91249 A1, which support rail is used to hold and supply power to a plurality of lighting units or lighting modules. A current-conducting profile extends in the longitudinal direction within the support rail, it being possible for said current-conducting profile to be electrically connected to the lighting modules. For operation, a conventional grid voltage—that is to say typically 230 V—is applied across the current-conducting profile. Each of the lighting modules has a fluorescent lamp as lighting means and electronic control gear for converting the grid voltage to an operating voltage which is suitable for operating the fluorescent lamp in question.

Recently, lighting means based on LEDs (LED: light-emitting diode) have increasingly been used in lighting technology. An LED cannot be directly connected to the grid voltage; rather, a significantly lower voltage is required for operating said LED, said voltage being for example 3 V. Lighting modules with LED light sources therefore in principle require a so-called converter unit which appropriately converts the grid or supply voltage supplied by the light strip system or by the support rail for operating the LED light source in question.

From a particular total length of a light strip system with LED lighting modules, it is no longer possible to provide only a low voltage along the support rails in question since, in the case of a correspondingly low voltage, the losses in the current conductors for this purpose are too large.

A decorative lamp chain having a plurality of lamp bulbs is known from DE 20 2007 002 128 U1. The decorative lamp chain has a plug housing with a conductive plug connector unit, wherein a first cable and a second cable are electrically connected to said plug connector unit. The second cable leads on the other side firstly to a transformer at which the voltage is stepped down and subsequently to the lamp bulbs. The decorative lamp chain is provided to be hung on various objects, such as trees or homes. A support rail for holding the decorative lamp chain is not provided. In addition, the lamp bulbs are connected to the second cable in a particular manner; the decorative lamp chain does not have coupling elements for electrically connecting the lamp bulbs. Accordingly, that document does not suggest any support rail which is particularly easy to assemble.

An LED light is known from DE 20 2012 005 588 U1, which LED light has two LED lighting modules which are electrically connected to one another via a connecting element. Selection means are arranged in the connecting element and are electrically connected between a three-phase grid and the LEDs. A support rail for holding the lighting modules does not have said LED lights LED lights having a plurality of series-connected LED lighting modules are known from both documents US 2002/0114155 A1 and US 2009/0147504 A1. Corresponding support rails are not provided in the case of said lights, either.

The invention is based on the object of specifying a corresponding improved support rail; in particular, the support rail should be able to be produced particularly cost-effectively and enable a particularly easy-to-handle assembly. The support rail should also be suitable, in particular, for lighting modules based on LEDs. In addition, a corresponding light strip system is to be specified.

This object is achieved according to the invention by the subject matter specified in the independent claims. Particular embodiments of the invention are specified in the dependent claims.

According to the invention, a support rail is provided for holding and supplying power to a plurality of lighting modules, wherein the support rail has first conductors for forming a first power supply circuit. Furthermore, the support rail has second conductors for forming a second power supply circuit, and a converter unit for electrically coupling the second power supply circuit to the first power supply circuit. In this case, the second power supply circuit has a first coupling element for electrically connecting a first lighting module and a second coupling element for electrically connecting a second lighting module.

By virtue of this configuration of the second power supply circuit, it is possible to achieve a single converter unit which is sufficient for voltage conversion for the power supply of the two lighting modules. As a result of this, a particularly cost-effective and compact construction of the support rail is enabled. In addition, the two lighting modules can in this way be configured in each case without an individual converter or without an individual converter unit, with the result that the lighting modules per se can be configured to be particularly physically small and to have a low weight. As a result of this, the assembly of the lighting modules on the support rail is made simpler.

Furthermore, the first and the second conductors and the converter unit can be rigidly connected to the remainder of the support rail. It is thus possible for an end user to insert the lighting modules into the support rail in a particularly simple manner.

The support rail preferably extends along a longitudinal axis and, with reference to the longitudinal axis, has a first end region and a second end region, wherein the first power supply circuit has a first coupling element which is arranged in the first end region and a second coupling element which is arranged in the second end region. In this way, the first conductors of a plurality of similarly configured support rails which are arranged in a row one after the other can be easily connected to feed-through wiring for supplying power to the support rails.

The first coupling element of the second power supply circuit and the second coupling element of the second power supply circuit are preferably arranged on the remainder of the support rail, in each case in a stationary manner with respect to the longitudinal axis. As a result of this, it is possible to assemble the lighting modules on the support rail in a particularly simple manner.

The converter unit is preferably configured to provide a constant current for the second power supply circuit. This is particularly advantageous if the lighting modules are lighting modules with LEDs as light sources.

The first coupling element of the second power supply circuit and the second coupling element of the second power supply circuit are preferably connected in series. In this case, a two-pole configuration of the coupling elements is sufficient, as a result of which handling is simplified further. In addition, by virtue of the series connection, it is ensured that current only flows through the second power supply circuit when the coupling elements of the second power supply circuit—which may, in principle, be the two mentioned or even more than two which are all connected in series—are correspondingly populated with lighting modules. The output-side voltage or the output-side current of the converter unit can therefore be adjusted to this in advance, with the result that an end user does not need to be concerned in this regard.

The support rail preferably has a profile element which is substantially U-shaped in cross section and has a first section by virtue of which the first limb of the U is formed, a second section by virtue of which the second limb of the U is formed and a third section by virtue of which the connecting limb which connects the two limbs of the U to one another is formed, wherein the converter unit is arranged on the third section on a side lying opposite the first section and the second section. This configuration makes it possible to keep the height of the remaining support rail or the profile element relatively small; a correspondingly compact support rail has advantages in terms of construction technology, in particular if the support rail is to be integrated, for example in a concrete surface, since less material must thus be removed from the concrete surface in preparation for the installation.

The first conductors and/or the second conductors can in this case advantageously be arranged at least for the most part between the first section and the second section.

Preferably, the support rail is additionally configured to hold and supply power to at least one third lighting module, wherein the second power supply circuit additionally has at least one third coupling element for electrically connecting the at least one third lighting module and wherein all of the coupling elements of the second power supply circuit are arranged equidistantly. As a result of this, the support rail is suitable for lighting modules which are all the same length. Thus, assembly is further simplified for an end user.

As an alternative to this, the support rail is preferably configured, in addition, to hold and supply power to at least one third lighting module, wherein the second power supply circuit additionally has at least one third coupling element for electrically connecting the at least one third lighting module; in this case the configuration is such that the distance between the first coupling element of the second power supply circuit and the second coupling element of the second power supply circuit differs from the distance between the second coupling element of the second power supply circuit and the at least one third coupling element of the second power supply circuit. In particular, in this case, the second power supply circuit has a plurality of third coupling elements for electrically connecting a plurality of third lighting modules, wherein the plurality of third coupling elements are arranged equidistantly from one another and in this case each nearer to one another than the first coupling element and the second coupling element of the second power supply circuit. By virtue of this configuration, the support rail can be shortened in various ways, with the result that a light line with a particular desired length can be formed.

According to another aspect of the invention, a light strip system is provided, which has a support rail according to the invention, and a first lighting module which is electrically connected to the first coupling element of the second power supply circuit, and a second lighting module which is electrically connected to the second coupling element of the second power supply circuit.

In this case, a plurality of lighting modules are preferably mechanically held on the support rail and electrically connected to the support rail such that the lighting modules extend over the entire length of the support rail.

Further preferably, the light strip system additionally has a further support rail according to the invention, wherein the first conductors of the support rail and the first conductors of the further support rail are electrically connected to one another.

Figure 2:
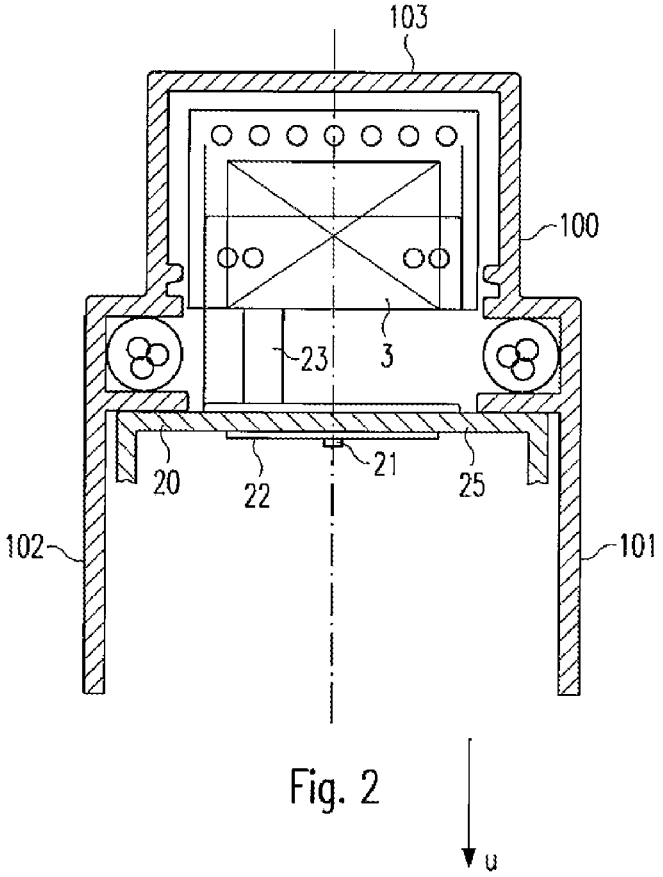
Figure 3:
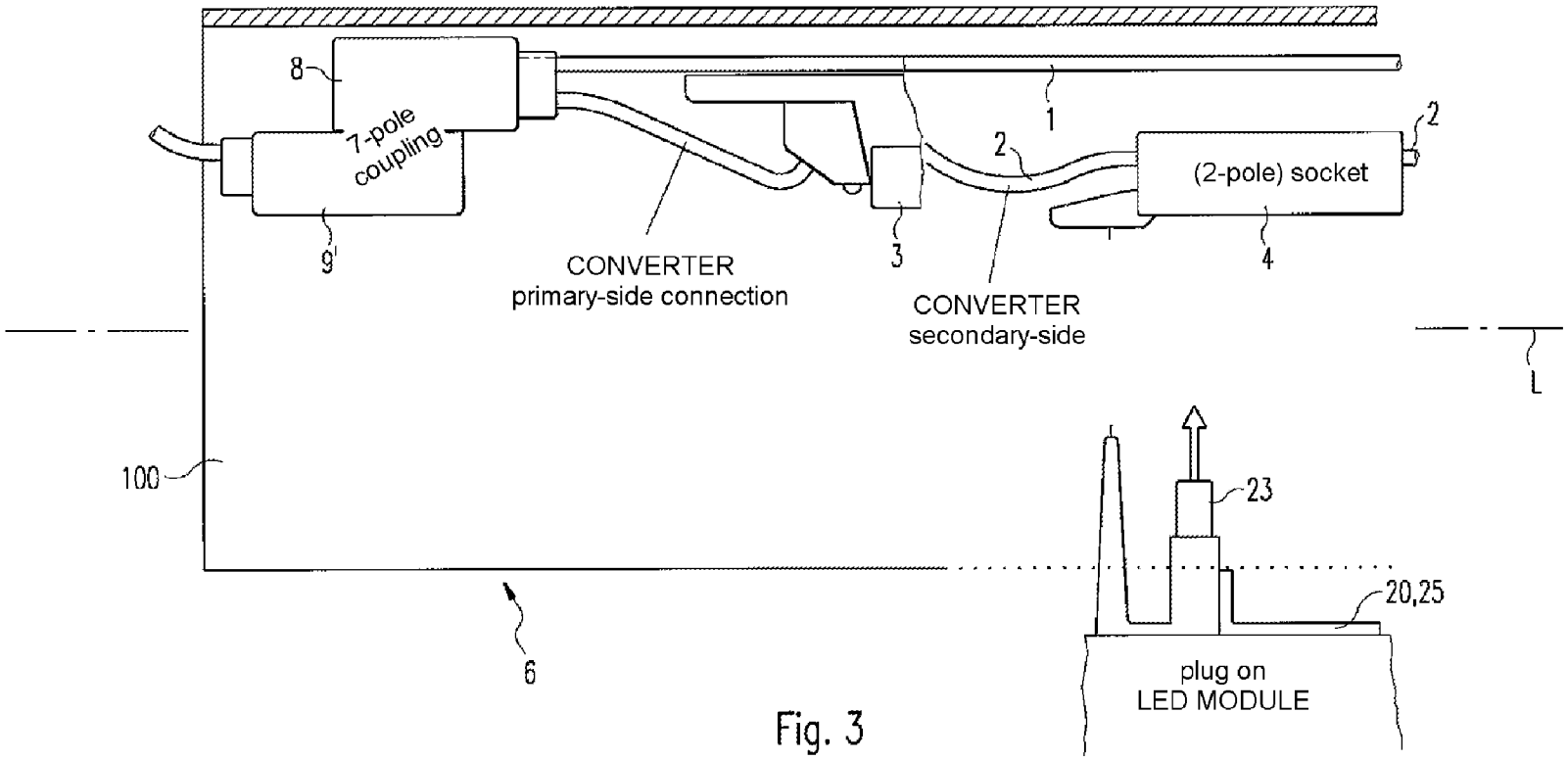
Figure 4:
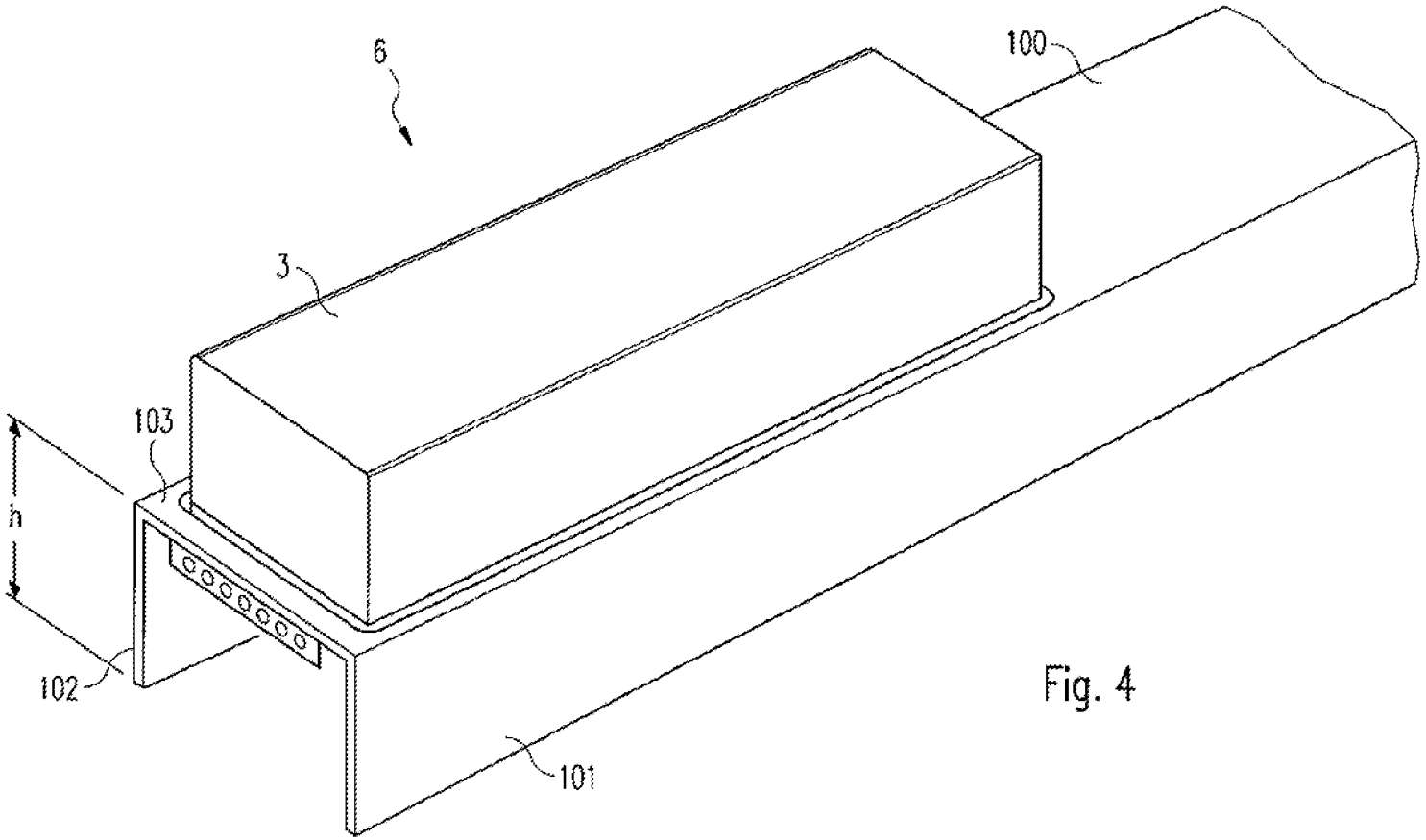
Figure 5A:
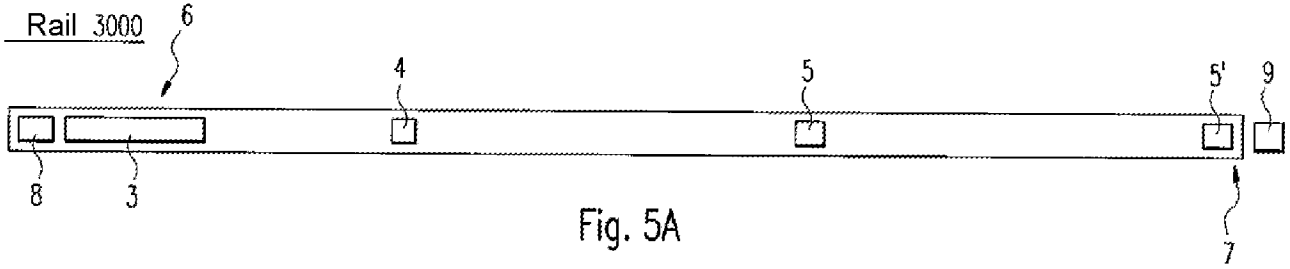
Figure 5B:
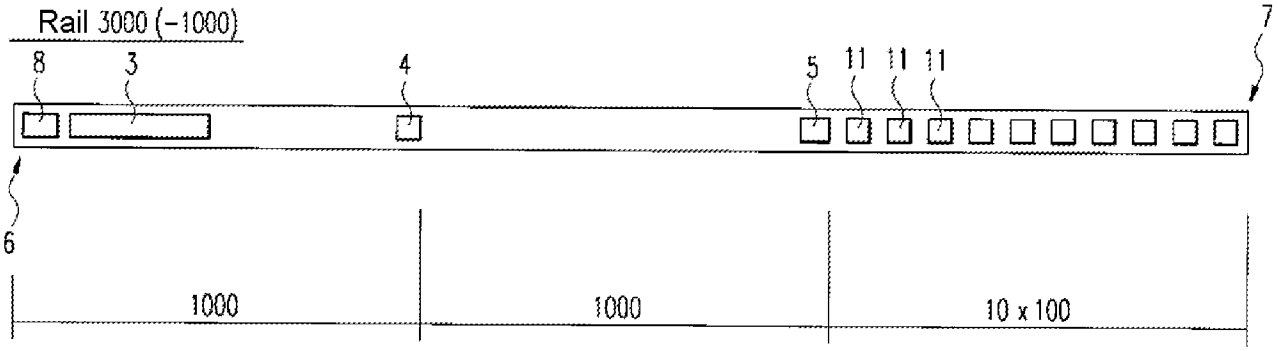

The invention is explained in more detail below on the basis of exemplary embodiments and with reference to the drawings, in which:

FIG. 1 shows a schematic outline of an exemplary embodiment of a support rail according to the invention, FIG. 2 shows an outline of a cross section through the support rail, FIG. 3 shows an outline in respect of a corresponding longitudinal section, FIG. 4 shows a perspective outline of an end region of a support rail according to one variant, and FIGS. 5A and 5B show mutually corresponding outlines in respect of the support rail and in respect of an end piece-support rail.

FIG. 1 shows a highly schematic outline of an exemplary embodiment of a support rail according to the invention. The support rail is elongate overall and correspondingly extends along a longitudinal axis L, with the result that, with reference to the longitudinal axis L, the support rail has a first end region 6 and a second end region 7. FIG. 2 shows an outline of a cross section through the support rail normal to the longitudinal axis L. FIG. 4 shows—with analogous application of the reference signs—a perspective outline of the first end region 6 of one variant of the support rail.

The length of the support rail may be, for example, 2 m, 3 m or 4 m.

The support rail is configured to mechanically hold and supply electrical power to a plurality of lighting modules. A corresponding lighting module 20 is indicated by way of example in FIG. 2. The lighting modules 20 can be, in particular, lighting modules based on LEDs, that is to say lighting modules the light-generating elements of which are formed—in particular exclusively—from LEDs 21, also referred to as "LED lighting module" here.

A corresponding LED lighting module can have a profile element 25 composed of aluminum, with the result that it is elongate overall and is configured to be oriented parallel to the support rail and mechanically and electrically connected to the latter. At least one printed circuit board 22 can be arranged on the profile element 25, on which printed circuit board the LEDs 21 are arranged along the length of the LED lighting module.

In addition, the LED lighting module 20 can have a primary optical unit (not shown in the figures) for spatial resolution of the light output by the LEDs, and protection against contact, which can be formed by the primary optical unit, for example.

For the purposes of the description, it is assumed that the support rail is set up such that—as shown in FIG. 2—light is output downward u by the lighting modules 20. However, any desired orientation is possible in principle. If appropriate, corresponding orientation specifications in this description are to be reinterpreted.

The support rail preferably has a profile element 100, for example made of aluminum, which is U-shaped in cross section to the first approximation and has a first section 101 by virtue of which one of the two corresponding limbs of the U is formed, a second section 102 by virtue of which the other limb of the U is formed and a third section 103 by virtue of which the connecting limb which connects the two limbs of the U to one another is formed. In this case, the profile element 100 is set up such that the two limbs of the U point downward u starting from the connecting limb. In other words, the U-shaped profile element 100 is oriented so as to be open in the downward direction.

In this case, the configuration is preferably such that the lighting modules 20 are arranged completely between the two limbs of the U or between the first section 101 and the second section 102 if they are held on the support rail as provided.

In the variant shown in FIG. 4, the profile element 100 has a somewhat different shape than in the case of the example shown in FIG. 2; however, it is likewise correspondingly U-shaped in cross section. Reference is made to this again below.

As outlined in FIG. 1, the support rail has first conductors 1 for forming a first power supply circuit.

The support rail is preferably configured to form a light strip system with other similarly constructed support rails, wherein the support rails are in each case arranged oriented parallel to the longitudinal axis L in a row one after the other and are electrically connected to one another. With such a light strip system, it is possible thus to form a "light line" of in principle any length.

The support rail preferably has mechanical connecting elements for this purpose in the two end regions 6, 7, which mechanical connecting elements are configured for corresponding mechanical connection to another similarly configured support rail.

The support rail for forming the light strip system is also preferably configured such that the first conductors 1 in the two end regions 6, 7 can easily be connected to corresponding first conductors of a similarly configured further support rail. Accordingly, the first power supply circuit advantageously has a first coupling element 8, which is arranged in the first end region 6, and a second coupling element 9, which is arranged in the second end region 7. Preferably, the first coupling element 8 is a socket and the second coupling element 9 is a plug which corresponds to said socket—or vice versa.

FIG. 3 shows an outline in respect of a longitudinal section around the first end region 6 of the support rail. In this case, the first coupling element 8 is outlined to be electrically connected to a corresponding second coupling element 9' of another similarly configured support rail.

The first conductors 1 are advantageously configured to be connected to a conventional grid voltage, that is to say to a 230 V voltage supply, for example.

In a correspondingly formed light strip system, the respectively mutually connected first conductors of the support rails are used to form a continuous wiring for conducting the grid voltage to the individual support rails.

The first conductors 1 can have, for example, seven individual wires, via which control signals can also be sent in addition to the grid voltage, for example.

Furthermore, the support rail—denoted by way of example in FIG. 1—has second conductors 2 which are configured for forming a second power supply circuit.

In order to electrically couple the second power supply circuit to the first power supply circuit, the support rail also has a converter unit 3. The converter unit 3 can accordingly be connected on the input side to the first power supply circuit or to the first conductors 1 and on the output side to the second power supply circuit or to the second conductors 2. The converter unit 3 is outlined in FIG. 3 in a merely truncated fashion.

The converter unit 3 is preferably arranged in one of the two end regions 6, 7 of the support rail and in this case is electrically connected on the input side to the corresponding coupling element 8, 9 of the first power supply circuit. As outlined by way of example in FIGS. 1 and 3, the converter unit 3 can thus be arranged in the first end region 6 and in this case be electrically connected on the input side to the first coupling element 8 of the first power supply circuit.

In principle, two or more converter units can also be provided, for example in the case of a 4 m long support rail, two corresponding converter units can be provided. However, it is advantageous in respect of production and handling if the support rail has only one converter unit. This is easily possible in the case of a 2 m long or a 3 m long support rail.

The converter unit 3 is preferably configured to provide a constant current on the output side. If the lighting modules 20 are lighting modules based on LEDs, it is particularly advantageous if a constant current is made available to the second power supply circuit by the converter unit 3.

The second power supply circuit comprises a first coupling element 4 for electrically connecting a first lighting module, and a second coupling element 5 for electrically connecting a second lighting module. Further corresponding coupling elements can also be provided for connecting a corresponding number of further lighting modules.

What is achieved by the mentioned configuration is that a single converter unit is sufficient in order to operate a plurality of lighting modules.

The two coupling elements 4, 5 of the second power supply circuit are preferably sockets. The lighting modules 20 can in this case—as indicated in FIGS. 2 and 3—have simple plugs 23 with which they can be plugged into the sockets to form an electrical connection to the second power supply circuit in a particularly easy-to-handle manner.

In the case of the mentioned configuration, the first coupling element 4 and the second coupling element 5 of the second power supply circuit can be connected in series. The coupling elements 4, 5 can accordingly be only two-pole sockets. The plugs 23 of the lighting modules 20 can thus be configured simply as two-pole plugs. The production of the corresponding connections is particularly easy-to-handle in this case.

It is additionally ensured by the series connection that current only flows through the second power supply circuit if the lighting modules are correspondingly electrically connected to the coupling elements 4, 5. This also applies, of course, in the event that more than two coupling elements, which are all correspondingly connected in series, are arranged in the second power supply circuit.

By way of example, provision can be made that the converter unit 3 provides a constant current of 350 mA on the output side and, in this case, permits a voltage range of from 116 V to 195 V. In the series connection, the voltage then sums according to the number of connected LEDs 21. By way of example, the LEDs 21 can be 3 V high-power LEDs.

Alternatively, the converter unit 3 could be configured to provide a constant voltage on the output side, for example in the low-voltage range up to approximately 50 V. However, in this case, further electronic components are necessary for the lighting modules, which electronic components are configured to set a suitable current strength for the LEDs. If, by way of example, a low voltage of 24 V is provided by the converter unit 3, groups of at most eight 3 V LEDs can be realized in this case. If sixteen such LEDs are desired on a lighting module, two corresponding groups of in each case eight LEDs could be connected in parallel. However, in this case, there are generally differences in brightness between the groups.

The converter unit 3 can be arranged, for example, inside the U-shaped profile element 100—as outlined by way of example in FIGS. 2 and 3—that is to say between the first section 101 and the second section 102 of the profile elements 100. Alternatively, the converter unit 3 can be arranged on the third section 103—as is the case in the variant outlined in FIG. 4—and in this case on a side lying opposite the first section 101 and the second section 102 or on top of the third section 103, that is to say "put on top", so to speak. In the case of this configuration, the first section 101 and the second section 102 of the profile element 100 can be configured with a smaller vertical extent h in comparison with the embodiment outlined in FIG. 2. This is particularly advantageous if the support rail is to be installed, for example in a concrete surface since, in such a case, it is sufficient for the reinforcement of the concrete surface to be removed, in preparation for installation, only at that point at which the converter unit 3 is intended to be installed. The remaining section of the support rail can then be arranged below the reinforcement. This is also advantageous in respect of static. In addition, a correspondingly more compact support rail can better withstand mechanical demands, for example in respect of concrete pressure or the forces of a vibrator.

The first conductors 1 and the second conductors 2 are —as is also the case per se in the example shown in FIGS. 2 and 3—preferably at least for the most part arranged between the first section 101 and the second section 102 or below the third section 103.

Preferably, the first coupling element 4 and the second coupling element 5 of the second power supply circuit are arranged on the remainder of the support rail, in each case in a stationary manner with respect to the longitudinal axis L. In FIG. 1, this is indicated by the positions x1 and x2 of an x axis parallel to the longitudinal axis L. By virtue of such a stationary or positionally fixed arrangement of the coupling elements 4, 5, assembly of the lighting modules 20 is further facilitated.

The configuration is preferably such that the positions x1, x2, at which the coupling elements 4, 5 are arranged, are adjusted on the length of the lighting modules 20. In this case, provision is advantageously made that, in the event that the support rail is fully populated with lighting modules, the lighting modules extend practically over the entire length of the support rail, with the result that a continuous light line can be formed using the lighting modules. In addition, the support rail and the lighting modules are preferably configured such that, in the case of a corresponding light strip system, no visible boundary is formed at a joint between two support rails—in particular when the lighting modules in question are outputting light.

By way of example, provision can be made that the lighting modules 20 have a length of in each case 1 m and the support rail is 3 m long, with the result that the support rail is fully populated with three lighting modules and thus a light line which extends in an unbroken manner over the entire length of the support rail can be produced. In this case, the support rail or the second power supply circuit therefore has a further, similarly configured coupling element 5' in addition to the first and the second coupling element 4, 5.

Practice has shown that end users of corresponding light strip systems generally want correspondingly continuous, unbroken light lines.

If the three coupling elements 4, 5, 5' are arranged equidistantly, with the result that the following applies for the corresponding three positions: x2−x1 =x3−x2, the support rail can be populated with lighting modules which are all the same length. As a result of this, assembly is further simplified for an end user. In addition, in this case, merely one type of lighting module is sufficient. Of course, this advantage always presents itself when all of the coupling elements of the second power supply circuit are arranged in a correspondingly equidistant manner, that is to say even in the case of four or even more coupling elements of the second power supply circuit.

The coupling elements 4, 5, 5' and the converter unit 3 can be arranged in an operationally ready manner during manufacture of the support rail in the factory, with the result that an end user must connect only the lighting modules 20 as provided mechanically to the support rail and electrically to the coupling elements 4, 5, 5' in order to populate the support rail. In particular, it is not necessary for the end user to concern himself with the output-side electrical power of the converter unit 3 since—in the case of full population with lighting modules being provided—the converter unit 3 can already be correspondingly set up or prepared in advance or in the factory.

If all of the lighting modules 20 of a light strip system have a particular, uniform length—for example 1 m—handling is therefore particularly easy for an end user since he has fewer different types of individual components to deal with. However, in this case, he is correspondingly restricted with respect to the total length of the light line to be formed.

In order in this regard to enable an end user to have more configuration space, a variant of the support rail is provided—referred to here as "end piece-support rail" since it is suitable as end-side support rail of a light strip system.

This variant or the end piece-support rail is outlined in FIG. 5B. By way of comparison, the support rail according to the exemplary embodiment first mentioned is correspondingly outlined in FIG. 5A. The reference signs are again used analogously in this case.

In comparison to the exemplary embodiment first mentioned, the end piece-support rail is additionally configured to hold and supply power to at least one third lighting module. For this purpose, the second power supply circuit further has at least one third coupling element 11 for electrically connecting the at least one third lighting module. In this case, the configuration is such that the distance between the first coupling element 4 and the second coupling element 5 of the second power supply circuit—that is to say for example 1 m—differs from the distance between the second coupling element 5 and the at least one third coupling element 11 of the second power supply circuit. Accordingly, the length of the at least one third lighting module is also different from the first lighting module.

In the case of the embodiment of the end piece-support rail shown here, the second power supply circuit has a plurality of third coupling elements 11, wherein the plurality of third coupling elements 11 are arranged equidistantly with respect to one another and, in this case, in each case are arranged nearer to one another than the first coupling element 4 and the second coupling element 5 of the second power supply circuit. By way of example, the distances between the third coupling elements 11 can be in each case 10 cm, wherein ten third coupling elements 11 are advantageously arranged and, with reference to the second coupling element 5 of the second power supply circuit, are arranged on the side lying opposite the first coupling element 4 of the second power supply circuit. That one of the third coupling elements 11 which is closest to the second coupling element 5 is in this case preferably likewise arranged at a distance of 10 cm from the latter.

In other words, the ten third coupling elements 11 are equidistantly arranged in the "last meter" of the end piece-support rail. The at least one third lighting module correspondingly preferably has a length of 10 cm. Said "short" lighting modules can also be configured without converter unit or other electronics and are therefore able to be configured particularly cost-effectively. In addition, they are able to be configured to be particularly short, in principle, since they do not require any converter unit.

In order to form a light line in a particular desired length, the end user can simply shorten the end piece-support rail between any two of the third coupling elements 11 or between the second coupling element 5 and the next closest one of the third coupling elements 11, for example by sawing.

The second conductors 2 are in this case simply electrically connected to one another at the sawn-off end, for example by means of a terminal in order thus to close the second power supply circuit again.

In the case of the end piece-support rail, the first power supply circuit must have a coupling element only in that end region which is provided for connecting another support rail, that is to say, in the case of the end piece-support rail shown in FIG. 5B, at the first end region 6.

The grid voltage can be fed in via the correspondingly free coupling element of the first power supply circuit at that support rail which is located at the other end of the light strip system.

Owing to the possibility of being able to form the length of the light line with corresponding preciseness, that is to say for example to precisely 10 cm, the end user can adapt the light strip system particularly well to framework conditions at the installation.

By way of example, the light line on the ceiling in a room can be configured such that it stretches from one wall "all the way" to the opposite wall.

The end user of the support rail or of the light strip system must therefore only mechanically and electrically connect the support rails to one another and plug in the lighting modules for assembly. Further planning works or considerations are not necessary for the user since the light strip system is configured such that a continuously successive arrangement of lighting modules can occur without the need for checking whether the supply voltages provided by the converter units of the support rails are correspondingly suitable or sufficient. As a result of this, assembly is possible in a particularly easy-to-handle manner.

The invention claimed is:

1. An LED lighting strip system, comprising:

an elongate support rail axially extending along a longitudinal axis for holding and supplying power to a plurality of LED lighting modules, first conductors supported on and extending substantially along the length of the elongate support rail forming a first power supply circuit to distribute AC grid voltage, second conductors supported on and extending along the elongate support rail for forming a second power supply circuit to distribute a DC voltage, and a converter unit for electrically coupling the second power supply circuit to the first power supply circuit and converting the AC grid voltage to the DC voltage to power the LED lighting modules, wherein the second power supply circuit has a first DC coupling element for electrically connecting a first LED lighting module and a second DC coupling element for electrically connecting a second LED lighting module mounted in spaced apart orientation to the elongate support rail.

2. The LED lighting strip system as claimed in claim 1, wherein the elongate support rail has a first end region and a second end region and, the first power supply circuit has a first AC coupling element which is arranged in the first end region and a second AC coupling element which is arranged in the second end region.

3. The LED lighting strip system as claimed in claim 1, in which the first DC coupling element of the second power supply circuit and the second DC coupling element of the second power supply circuit are arranged on the support rail, in a stationary manner with respect to the longitudinal axis.

4. The LED lighting strip system as claimed in claim 1, in which the converter unit is configured to provide a constant DC voltage for the second power supply circuit.

5. The LED lighting strip system as claimed in claim 1, in which the first DC coupling element of the second power supply circuit and the second DC coupling element of the second power supply circuit are connected in series.

6. The LED lighting strip system as claimed in claim 1, wherein the elongate support rail has a substantially U-shaped in cross section and has a first limb section of the U, a second limb section of the U and a third section which connects the two limbs of the U to one another, wherein the converter unit is mounted to on the third section.

7. The LED lighting strip system as claimed in claim 6, in which the first conductors and the second conductors are arranged between the first section and the second limb section.

8. The LED lighting strip system as claimed in claim 1, further comprising at least one third LED lighting module and in which the second power supply circuit additionally has at least one third DC coupling element for electrically connecting the at least one third LED lighting module, wherein all of the DC coupling elements of the second power supply circuit are arranged equidistantly.

9. The LED lighting strip system as claimed in claim 1, further comprising to at least one third LED lighting module and in which the second power supply circuit additionally has at least one third DC coupling element for electrically connecting the at least one third LED lighting module, wherein the distance between the first DC coupling element of the second power supply circuit and the second DC coupling element of the second power supply circuit differs from the distance between the second DC coupling element of the second power supply circuit and the at least one third DC coupling element of the second power supply circuit.

10. The LED lighting strip system as claimed in claim 9, further comprising a plurality of third DC coupling elements for electrically connecting a plurality of third LED lighting modules, wherein the plurality of third DC coupling elements are arranged equidistantly from one another and in this case each nearer to one another than the first DC coupling element and the second DC coupling element of the second power supply circuit.

11. The LED lighting strip system as claimed in claim 1, further comprising a first LED lighting module which is electrically connected to the first DC coupling element of the second power supply circuit, and a second LED lighting module which is electrically connected to the second DC coupling element of the second power supply circuit.

12. The LED light strip system as claimed in claim 11, in which the first and second LED lighting modules are mechanically held on the elongate support rail and electrically connected to the elongate support rail such that the lighting modules extend over the entire length of the support rail.

13. The LED light strip system as claimed in claim 2, wherein the first AC coupling element and the second AC coupling element are configured to cooperate with one another enabling two LED light strip systems to be axially aligned and electrically connected transmitting AC grid voltage therebetween.

* * * * *